US008038416B2

(12) United States Patent
Ono et al.

(10) Patent No.: US 8,038,416 B2
(45) Date of Patent: Oct. 18, 2011

(54) OIL PUMP PRESSURE CONTROL DEVICE

(75) Inventors: Yasunori Ono, Gunma-ken (JP); Keiichi Kai, Gunma-ken (JP); Kenichi Fujiki, Gunma-ken (JP); Kosuke Yamane, Gunma-ken (JP)

(73) Assignee: Yamada Manufacturing Co., Ltd., Kiryu-shi, Gunma-ken (JP)

( * ) Notice: Subject to any disclaimer, the term of this patent is extended or adjusted under 35 U.S.C. 154(b) by 822 days.

(21) Appl. No.: 12/000,747

(22) Filed: Dec. 17, 2007

(65) Prior Publication Data

US 2008/0190496 A1 Aug. 14, 2008

(30) Foreign Application Priority Data

Feb. 13, 2007 (JP) ..... 2007-032715
Sep. 13, 2007 (JP) ..... 2007-237536

(51) Int. Cl.
*F04B 49/00* (2006.01)

(52) U.S. Cl. .... 417/286; 417/287; 418/196; 137/565.15

(58) Field of Classification Search ..... 417/279, 417/280, 286, 287; 418/196; 137/565.15
See application file for complete search history.

(56) References Cited

U.S. PATENT DOCUMENTS 4,245,964 A * 1/1981 Rannenberg ..... 417/287
4,502,845 A 3/1985 Chana
5,087,177 A * 2/1992 Haley et al. ..... 417/426
6,361,287 B1 * 3/2002 Hopper ..... 417/286
6,978,746 B2 * 12/2005 Kibler ..... 123/90.12
2005/0098385 A1 5/2005 Ono et al.
2005/0262824 A1 * 12/2005 Yates et al. ..... 60/39.281

FOREIGN PATENT DOCUMENTS

EP 1 529 958 A2 5/2005
JP 2002-70756 3/2002
JP 2005-6481 1/2005
JP 2005-140022 6/2005

OTHER PUBLICATIONS

European Search Report dated Aug. 14, 2009.

* cited by examiner

*Primary Examiner* — Charles Freay
*Assistant Examiner* — Patrick Hamo
(74) *Attorney, Agent, or Firm* — McGinn Intellectual Property Law Group, PLLC

(57) ABSTRACT

A device including a first discharge passage from a first rotor assembly to an engine, a first return passage that returns to an intake side of the first rotor assembly, a second discharge passage from a second rotor assembly to the engine, a second return passage that returns to an intake side of the second rotor assembly, and a pressure control valve whose valve main body is provided between a discharge port from the second rotor assembly and the first discharge passage. The first discharge passage and the second discharge passage are coupled, and a flow passage control is executed in each of: a low revolution range; an intermediate revolution range; and a high revolution range.

14 Claims, 9 Drawing Sheets

FLOW PASSAGE-ALTERING MECHANISM

OIL PUMP PRESSURE CONTROL DEVICE

BACKGROUND OF THE INVENTION

1. Field of the Invention

The present invention relates to an oil pump pressure control device that facilitates a reduction in friction while maintaining characteristics identical to the pressure characteristics of a common oil pump based on the provision of a plurality of discharge sources and a newly devised method of switching oil passages.

2. Description of the Related Art

While a variable flow rate oil pump of the conventional art comprises two discharge ports configured from a single discharge port partitioned into two, because of the single rotor assembly thereof, from the viewpoint of the discharge source there is still a single discharge port. In addition, at times of high revolution when the amount of power consumed by the pump is high, oil passages of a main pump (first pump) and a sub-pump (second pump) are in communication. Accordingly, the pressure of the main pump is substantially equivalent to the pressure of the sub-pump. Although reference is made herein to a main pump and a sub-pump, obviously these pumps constitute a single pump (a single rotor), and little or no reduction in superfluous work, should it occur, can be achieved using a single pump. Furthermore, because the discharge passage of the sub-pump terminates within a valve, there is a limit to the flow rate regulation afforded by the valve alone.

SUMMARY OF THE INVENTION

Japanese Unexamined Patent Application No. 2005-140022 describes a device designed with the aim of decreasing superfluous work and increasing efficiency at the low revolution range based on oil being relieved (returned) at a desired revolution range. Referring to FIG. 8 of page 13 of this document, superfluous work is decreased and efficiency is increased as a result of the flow rate being lowered in a desired revolution range. However, relief occurs even at times of high-speed revolution while the sub pump and main pump in communication and, accordingly, gives rise to the following problems. The sub-pump works to generate (discharge) a pressure the same as the pressure of the main pump and, accordingly, there is a limit to the extent to which the superfluous work is reduced.

While a valve is regulated in order to reduce superfluous work, fluctuations in the main flow rate and the sub flow rate (pressure) created by regulation of the valve relief position are directly linked to all fluctuations in overall flow rate (pressure) of the pump, a large number of steep inflection points caused by displacement and resultant overlapping of inflection points of the main flow rate and the sub flow rates occur in the overall flow rate (pressure) of the pump, vibration is generated by this large number of steep points and, accordingly, the pipe load and generated noise increases.

In addition, because the flow rate (pressure) fluctuations produced by the valve are unaffectedly directly linked to the overall flow rate (pressure) fluctuations of the pump, in the absence of the manufacturing thereof with a significantly high level of dimensional precision, pump performance variations will occur. A step-like transition in characteristics occurs rather than a linear transition and, accordingly, the effect of these variations is more conspicuous. In addition, because the discharge oil passage of the sub-pump passes through the valve and is subsequently immediately coupled to the main pump, there is a limit to the extent to which the sub pump flow rate (pressure) is caused to fluctuate by the valve alone.

Thereupon, the problem (technical problem and object and so on) to be solved by the present invention is to facilitate a reduction in friction while maintaining characteristics identical to the pressure characteristics of a common oil pump (The oil pump according to Japanese Unexamined Patent Application No. JP2002-70756 that exhibits the non-linear stepped characteristic passing through the broken line as shown in FIG. 10 of page 7 thereof, and comprises a valve with a ON/OFF relief function. In addition, which exhibits approximately one characteristic inflection point) based on the provision of a plurality of discharge sources and a newly devised method of switching oil passages.

Thereupon, as a result of exhaustive research conducted by the inventors with a view to resolving the problems described above, the aforementioned problems were able to be solved by the oil pump pressure control device of the invention of claim 1 comprising: a first discharge passage for feeding oil from a first rotor assembly to an engine; a first return passage that returns to an intake side of the aforementioned first rotor assembly; a second discharge passage for feeding oil from a second rotor assembly to the engine; a second return passage that returns to an intake side of the aforementioned second rotor assembly; and a pressure control valve whose valve main body configured from a first valve portion, a narrow-diameter coupling portion and a second valve portion is provided between a discharge port from the aforementioned second rotor assembly and the aforementioned first discharge passage, the aforementioned first discharge passage and the aforementioned second discharge passage being coupled, and a flow passage control being executed in each of: a low revolution range in a state in which only the first discharge passage and the second discharge passage are open; an intermediate revolution range in a state in which the first discharge passage and the second discharge passage are open and the aforementioned first return passage is closed while the second return passage opens; and a high revolution range in a state in which the second discharge passage is closed while the first discharge passage opens and the first return passage and the second return passage are open.

In addition, the aforementioned problems were able to be solved by the invention of claim 2 according to the configuration described above by the first rotor assembly and the second rotor assembly each being configured to serve as respectively separate oil pumps. In addition, the aforementioned problems were found to be solved by the invention of claim 3 according to the configuration described above by the first rotor assembly and the second rotor assembly being configured as a single oil pump with at least three rotors.

The effect of the invention as claimed in claim 1 is to prevent a drop in the overall pump pressure at times of high-speed revolution when the second discharge passage of the second rotor assembly is fully closed so as to form the second rotor assembly as an independent circuit whereupon, even in the absence of a superfluous work pressure being generated by the second rotor assembly, there is no drop in overall pump pressure. In addition, because work=pressure×flow rate the superfluous work can be reduced if the pressure is lowered. As described in the conventional art, when the first discharge passage of the first rotor assembly and the second discharge passage of the second rotor assembly are in communication, the pressure of the second rotor assembly does not drop below the pressure of the return passage of the first rotor assembly. In addition, because the second rotor assembly is formed as an independent circuit during high-speed revolution, provided the opened area of the return passage of the second rotor assembly is enlarged, more oil can be discharged and the pressure of the second rotor assembly further decreased. In addition, in the second rotor assembly, because the second discharge passage of the second rotor assembly is fully closed at times of high revolution, the flow rate (pressure) of the pump as a whole is influenced by the flow rate (pressure) of the first rotor assembly only.

In addition, because the exhibited appearance of the flow rate of the second rotor assembly (pressure) at times of high-speed revolution is removed, the influence thereof on pump as a whole is removed and, accordingly, the pump characteristics shift from a stepped characteristic to a linear characteristic, and the need for further significant alteration to the dimensional precision, which has been an inherent problem in conventional variable flow rate pumps, is eliminated. Because the first rotor assembly and the second rotor assembly constitute separate discharge sources and comprise separate discharge passages to the valve, the control of the two circuits performed by the valve can be more precisely executed (there are limits to the valve control when communication occurs prior to the valve). In addition, because the second discharge passage of the second rotor assembly does not extend downstream of the valve, the second rotor assembly is more liable to be affected by the valve opening/closing, and alteration to the flow rate (pressure) of the second rotor assembly by means of the valve is easy. In addition, because there are two discharge sources, the amount of work performed by a single rotor can be reduced, and superfluous work further reduced.

In the invention of claim 2 in which the aforementioned first rotor assembly and the aforementioned second rotor assembly are configured as separate oil pumps, vibration, noise and discharge pulse and so on are able to be negated and reduced by the two pumps. Furthermore, in the invention of claim 3 in which the aforementioned first rotor assembly and the aforementioned second rotor assembly are configured as a single oil pump having at least three rotors, a reduction in the space, weight, and number of component parts can be achieved.

DESCRIPTION OF THE PREFERRED EMBODIMENTS

Figure 1:
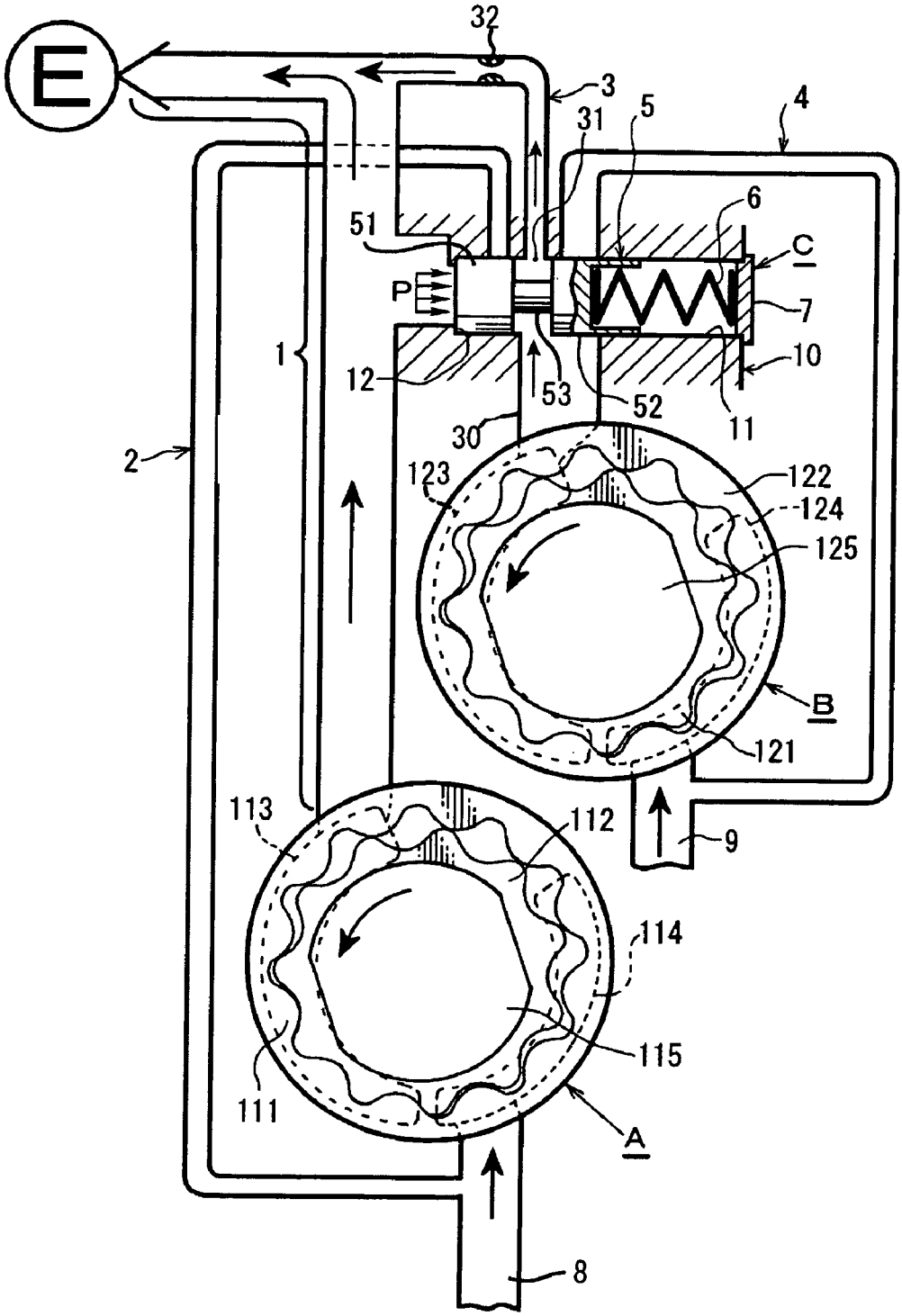
FIG. 1 is a systems diagram of a first embodiment of the present invention showing a state in an engine low revolution range.
Figure 2:
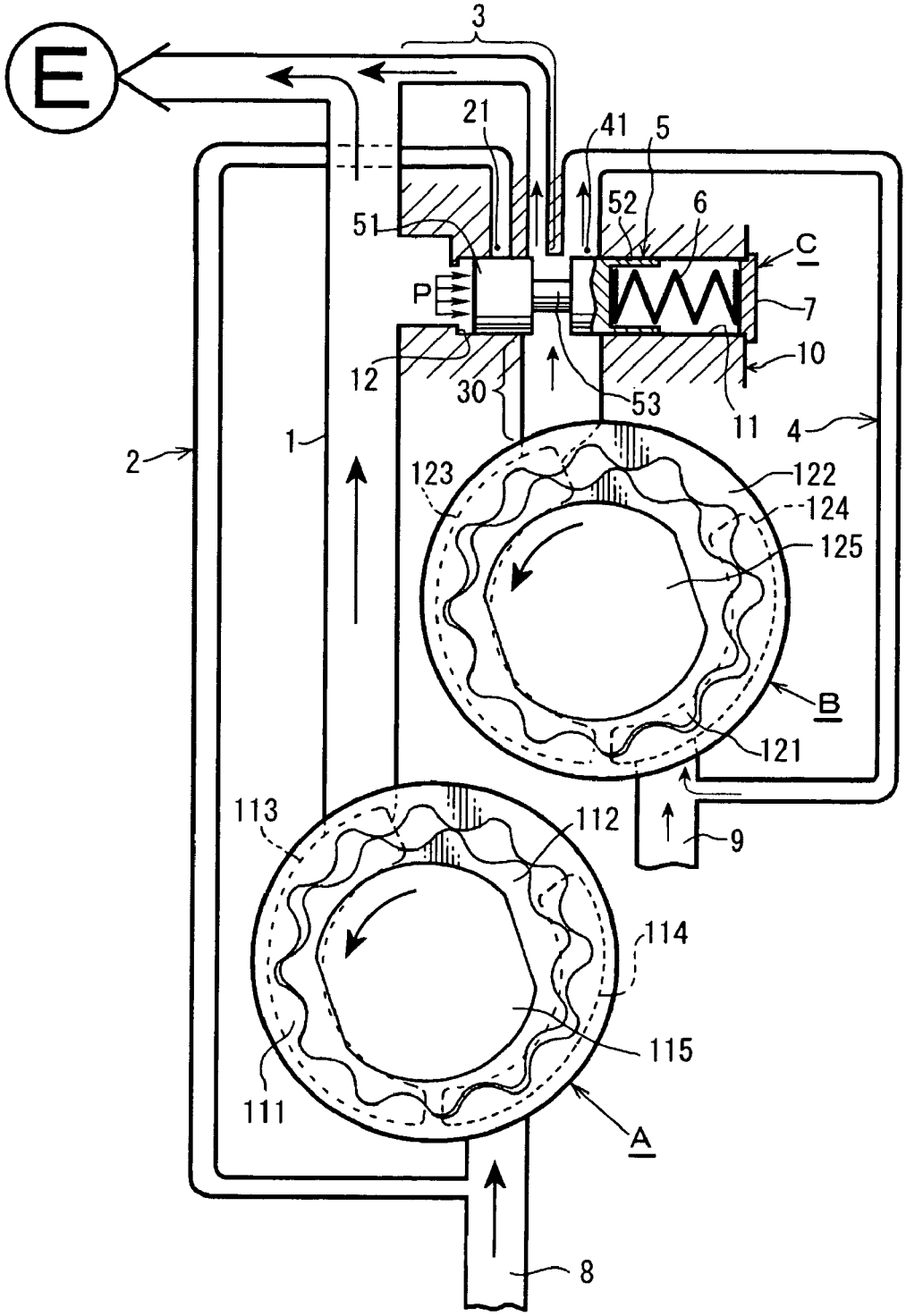
FIG. 2 is a systems diagram of the first embodiment of the present invention showing a state in an engine intermediate revolution range.
Figure 3:
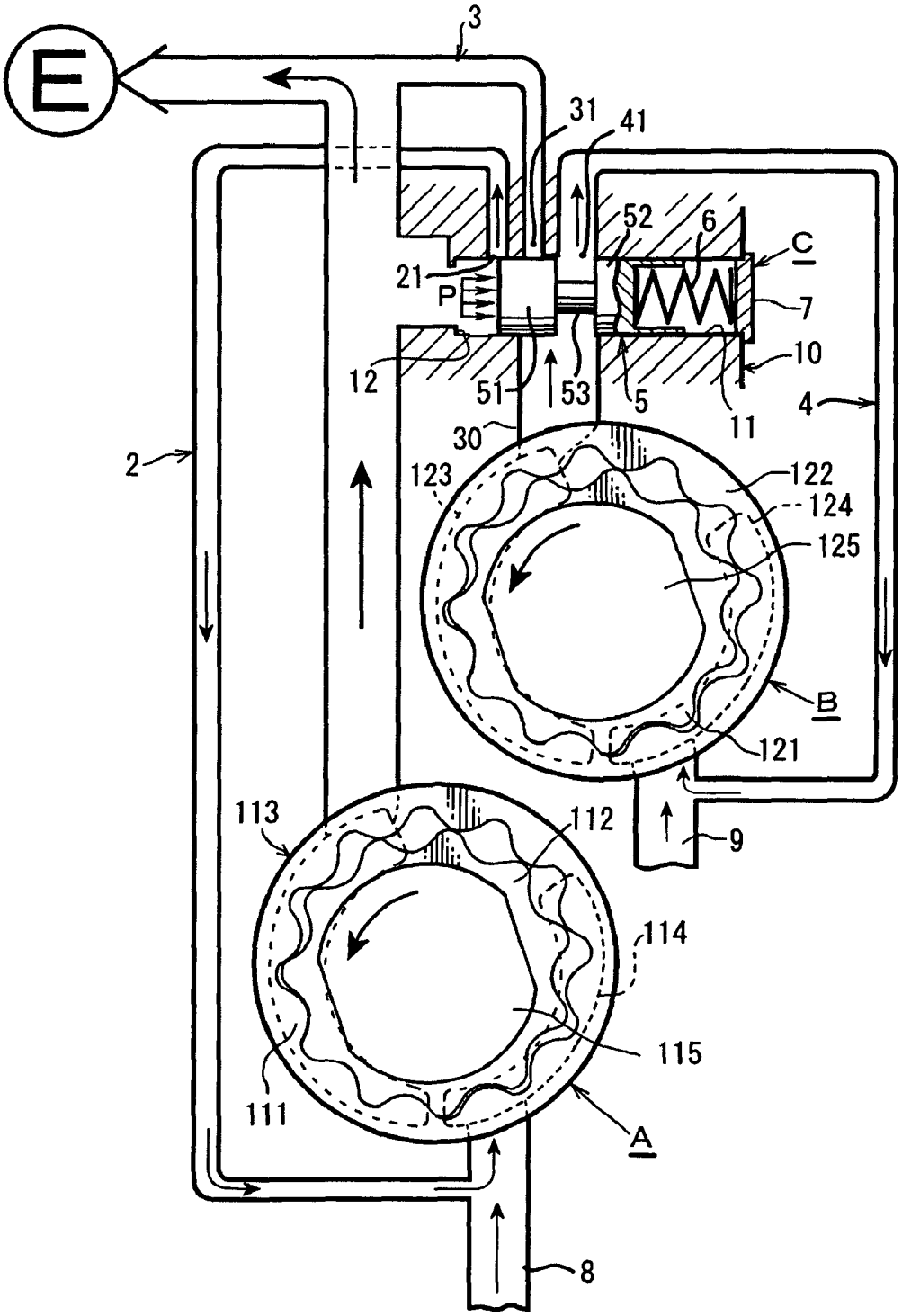
FIG. 3 is a systems diagram of the first embodiment of the present invention showing a state in an engine high revolution range.

In a description of the embodiments of the present invention given hereinafter with reference to the drawings, as shown in FIG. 1 to FIG. 3, the symbol A denotes a first rotor assembly and B denotes a second rotor assembly, each of which constitutes an oil pump configured from an outer rotor, an inner rotor and discharge port, and an intake port and so on provided in a casing. The device is configured from a first discharge passage 1 for feeding oil to an engine E, a first return passage 2 that returns to an intake passage 8 of the aforementioned first rotor assembly A, a second discharge passage 3 for feeding oil to the engine E, and a second return passage 4 that returns to an intake passage 9 of the aforementioned second rotor assembly B, an end portion side of the aforementioned second discharge passage 3 being coupled with the aforementioned first discharge passage 1 at a suitable position therealong. The first rotor assembly A and second rotor assembly B of this first embodiment constitute respectively separate pumps and, as shown in FIG. 1, the first rotor assembly A serving as an oil pump is configured from an outer rotor 111, an inner rotor 112, a discharge port 113 and an intake port 114. In addition, the second rotor assembly B serving as an oil pump is configured from an outer rotor 122, an inner rotor 121, a discharge port 123 and an intake port 124. The symbols 115 and 125 each denote drive shafts.

In addition, a valve main body 5 configured from a first valve portion 51, a narrow-diameter coupling portion 53 and a second valve portion 52 is provided to serve as a pressure control valve C in a suitable position of a valve housing 10 across the first discharge passage 1, the first return passage 2, the second discharge passage 3 and the second return passage 4. A long-hole portion 11 slidable as required in the valve aforementioned main body 5 is formed in the pressure control valve C, the aforementioned valve main body 5 being constantly push-pressured from a cover body 7 fixed in a rear portion side of the second valve portion 52 to the first valve portion 51 side by the elastic pressure produced by a compression coil spring 6 within this long-hole portion 11. The symbol 12 denotes a stopper portion formed in one end of the long-hole portion 11 and positioned in a suitable position of the first discharge passage 1.

In addition to the items that variously determine the pressure conditions, the diameter of the aforementioned valve main body 5 and the spring constant of the compression coil spring 6 and so on, the control of the pressure control valve C also requires that various conditions dependent on change in the discharge pressure of the abovementioned first discharge passage 1 be satisfied. More specifically, a flow rate control must be executed in each of a low revolution range which constitutes a state in which only the first discharge passage 1 and the second discharge passage 3 are opened as shown in FIG. 1, an intermediate revolution range which constitutes a state in which first discharge passage 1 and the second discharge passage 3 are open and the first return passage 2 is closed so that the second return passage 4 is open as shown in FIG. 2 and, in addition, in a high revolution range which constitutes a state in which the second discharge passage 3 is closed so that the first discharge passage 1 is open and the first return passage 2 and the second return passage 4 are open as shown in FIG. 3.

Figure 5A:
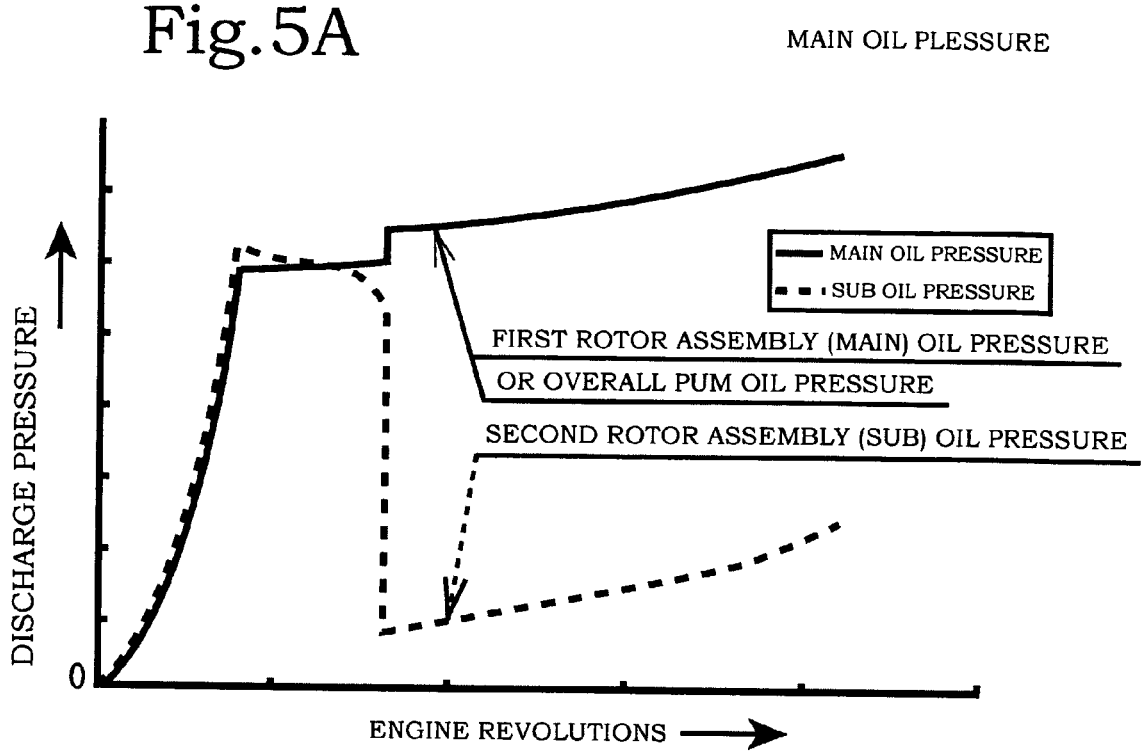
FIG. 5A is a characteristics graph of engine revolution and discharge pressure of the present invention.
Figure 5B:
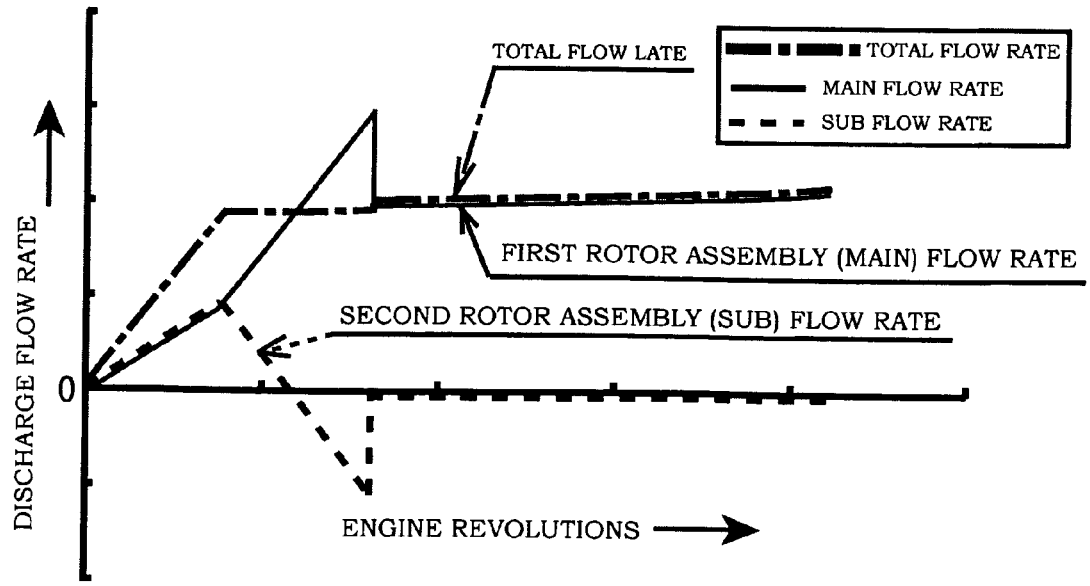
FIG. 5B is a characteristics graph of engine revolution and discharge flow rate of the present invention.

The operation of the pressure control valve C will be hereinafter described. First, in the low revolution range of the first rotor assembly A and the second rotor assembly B, in other words, when the engine revolution number is in the low revolution range which constitutes the state of FIG. 1, each of the return passages of the first rotor assembly A and the second rotor assembly B are closed by the first valve portion 51 and the second valve portion 52 of the pressure control valve C, and all oil discharged from the first discharge passage 1 and the second discharge passage 3 is discharged to the engine. The first discharge passage 1 of the first rotor assembly A and the second discharge passage 3 of the second rotor assembly B is in communication and, accordingly, an equalization of pressure occurs. In addition, because the return passages are closed, the overall discharge flow rate of the oil pump is equivalent to a sum of the flow rates of the first rotor assembly A and the second rotor assembly B. The characteristics produced in the low revolution range are shown in a characteristics graph of revolution number and discharge pressure [see FIG. 5A] in] and a characteristics graph of revolution number and discharge flow rate [see FIG. 5B].

A state in which the engine revolution number has risen further is taken as the intermediate revolution range. In this state, which constitutes the state of FIG. 2, an opening portion 41 of the second return passage 4 has started to open, and an opening portion 31 of the second discharge passage 3 has started to close. A more specific description thereof will be provided. The first discharge passage 1 of the first rotor assembly A and the second discharge passage 3 of the second rotor assembly B remains in communication. As a result of the opening portion 41 of the second return passage 4 of the second rotor assembly B starting to open, first, the rise in pressure in the second rotor assembly B stops. Simultaneously, because the first discharge passage 1 and the second discharge passage 3 are in communication, a backflow of oil from the discharge of the first rotor assembly A to the discharge side of the second rotor assembly B occurs and, in this state, is exhausted through the second return passage 4 of the second rotor assembly B and returned to the intake passage 9 of the second rotor assembly B. The state afforded by this series of actions results in a substantial equalization of the pressure of the first rotor assembly A and the pressure of the second rotor assembly B.

Because the opening portion 31 of the second discharge passage 3 of the second rotor assembly B gradually closes and the opening portion 41 of the second return passage 4 of the second rotor assembly B gradually opens consequent to a rise in the revolution number in the intermediate revolution range, the effect of a rise in the revolution number on the overall increase in the flow rate is negligible. In reality, the pressure not expressed in the true surface of the discharge of the second rotor assembly B gradually drops due to the opening portion 41 of the second return passage 4 of the second rotor assembly rotor B being gradually opened. However, because the first discharge passage 1 and the second discharge passage 3 are in communication, an equalization of the pressure of the first rotor assembly A and the second rotor assembly B occurs, and the pressure of the second rotor assembly B exhibits the appearance of not dropping.

In addition, because the opening portion 21 of the first return passage 2 is still not open in the intermediate revolution range, the discharge flow rate of the first rotor assembly A increases together with the revolution number. The discharge flow rate of the second rotor assembly B decreases along with the revolution number and the opening portion 41 of the second return passage 4 of the second rotor assembly B being opened. Because the backflow rate from the discharge of the first rotor assembly A exceeds the discharge flow rate of the second rotor assembly B subsequent to a certain revolution number being attained and, accordingly, the resultant discharge flow rate of the second rotor assembly B is negative. The generation of a negative flow rate in this way means that a flow rate equivalent to a sum of the flow rate of two oil pumps can be produced and a flow rate equivalent to less than a flow rate of a single pump can be produced. That is, a broad variation in flow rate is possible.

An orifice 32 (passage where the cross-sectional area flow rate is reduced) is provided along the second discharge passage 3 of the second rotor assembly B in accordance with need, a pressure loss that occurs at the location of the orifice 32 producing a drop in the discharge pressure of the second rotor assembly B. In addition, as a result of communication with the discharge of the first rotor assembly A subsequent to passing through the orifice 32, an equalization of pressure occurs. In other words, the pressure of the discharge of the second rotor assembly B prior to passing through the orifice 32 is slightly higher than the pressure of the discharge of the first rotor assembly A. For this reason, the initial-stage pressure of the discharge of the second rotor assembly B in the intermediate revolution range is slightly higher than the pressure of the first rotor assembly discharge. However, when the opened area of the opening portion 41 of the second return passage 4 of the second rotor assembly B increases and backflow of the oil from the discharge of the first rotor assembly A to the discharge side of the second rotor assembly B occurs, the effect of the orifice 32 is eliminated and an equalization of pressure of the discharge of the second rotor assembly B and the pressure of the discharge of the first rotor assembly A occurs. The characteristics at the intermediate revolution range are expressed in the pressure characteristics graphs of revolution number with respect to discharge pressure and discharge flow rate (see FIG. 5) and, while the increase in the first rotor assembly A is steady, a negative discharge flow rate is produced at the second rotor assembly B side due to backflow, and a pressure linking line obtained as a sum of the first rotor assembly A and the second rotor assembly B is substantially identical to the pressure characteristics of a conventional oil pump.

Figure 4:
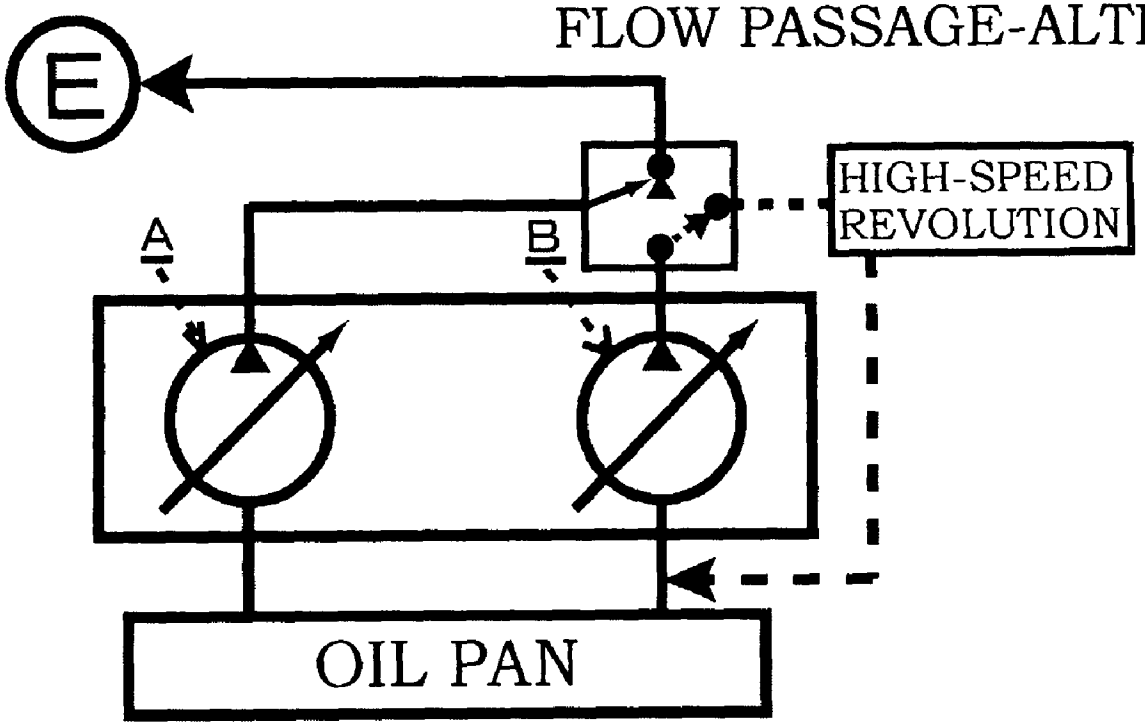
FIG. 4 is a simplified systems diagram of the present invention.

A state in which the engine revolution number has increased further is taken as the high revolution range. In this state, which constitutes the state of FIG. 3 or 4, the opening portion 21 of the first return passage 2 starts to open and the opening portion 31 of the second discharge passage 3 has finished closing. A more specific description thereof will be hereinafter provided. Because the discharge of the second rotor assembly B is fully closed, the discharge of the first rotor assembly A and the discharge of the second rotor assembly B are no longer in communication. That is to say, the second rotor assembly B is formed as an oil circuit independent of the first rotor assembly A. The pressure from the discharge of the first rotor assembly A is unable to reach the second rotor assembly B and is instead simply returned through the second return passage 4 of the second rotor assembly B, and this results in an instant drop in the pressure of the second rotor assembly B. Because backflow to the second rotor assembly B also stops and all the oil discharged from the second rotor assembly B is returned by way of the second return passage 4, a zero flow rate from the second rotor assembly B to the engine E is established. In other words, because the friction (torque) can be caused to drop instantly and superfluous work eliminated due to the zero flow rate of the second rotor assembly B and the discharge of the second rotor assembly B performing no work at all, the overall efficiency of the pump is increased. The characteristics at the intermediate revolution range are expressed in the pressure characteristics graphs of revolution number with respect to discharge pressure and discharge flow rate (see FIG. 5) and, while the increase in the first rotor assembly A is gradual, the second rotor assembly B is in a closed state and a pressure linking line obtained as a sum of the first rotor assembly A and second rotor assembly B is equivalent to the first rotor assembly A alone. Because of the decrease in friction (torque) due to the drop in the pressure of the second rotor assembly B in this way, the efficiency is increased.

Regarding the first rotor assembly A pressure, while a return of oil occurs by way of the second return passage 4 in the intermediate revolution range because the first discharge passage 1 and the second discharge passage 3 are in communication, because of the continuous return from the first return passage 2 that occurs in the high revolution range, the change in the first rotor assembly pressure between the intermediate revolution range and the high revolution range is negligible. In addition, because the opening portion 21 of the first return passage 2 opens and overflow to the first return passage 2 occurs at the instant of opening thereof, the change in the first rotor assembly A flow rate occurring subsequent to this drop in flow rate is negligible. Strictly speaking, very little rise occurs consequent to the increase in the revolution number.

Because the opening portion 31 of the second discharge passage 3 of the second rotor assembly B is fully closed the "pressure" of the pump main body (sum of the first rotor assembly A and second rotor assembly B) is equivalent to the pressure of the first rotor assembly A alone. While the change in the pressure of the first rotor assembly A is negligible due to the opening portion 21 of the first return passage 2 being open, strictly speaking, only a very gradual increase in pressure occurs consequent to an increase in the revolution number. In addition, for the "flow rate" of the pump main body, because the opening portion 31 of the second discharge passage 3 of the second rotor assembly B is fully closed, the "flow rate" of the first rotor assembly A constitutes the overall pump flow rate. While hardly any change in the pressure of the first rotor assembly A occurs due to the opening portion 21 of the first return passage 2 being open, strictly speaking, only a very gradual increase in pressure occurs consequent to the increase in the revolution number.

While the invention of the subject application constitutes an oil pump pressure control device as described above, it may also constitute a variable flow rate oil pump. This oil pump comprises two discharge passages in which the discharge source also uses a dual rotor assembly (double rotor or at least three rotors). In addition, at times of high revolution when the amount of power consumed by the pump is high, because a discharge port 30 or the second discharge passage 3 of the second rotor assembly B are closed, the first rotor assembly A and the second rotor assembly B are disengaged. Because the flow rate and the pressure of the second rotor assembly B no longer have any effect at all on the flow rate and pressure of the pump main body, even if the flow rate and pressure of the rotor B are regulated with the aim of increasing efficiency, this has no effect at all on the pump characteristics and, accordingly, allows for the increased degree of design freedom thereof. In addition, when two discharge sources are formed as separate pumps, the superfluous work of a single pump at times of high revolution can be markedly reduced. Furthermore, because the second discharge passage 3 of the second rotor assembly B extends downstream of the pressure control valve C, flow rate regulation of the pressure control valve C is easy.

Figure 6:
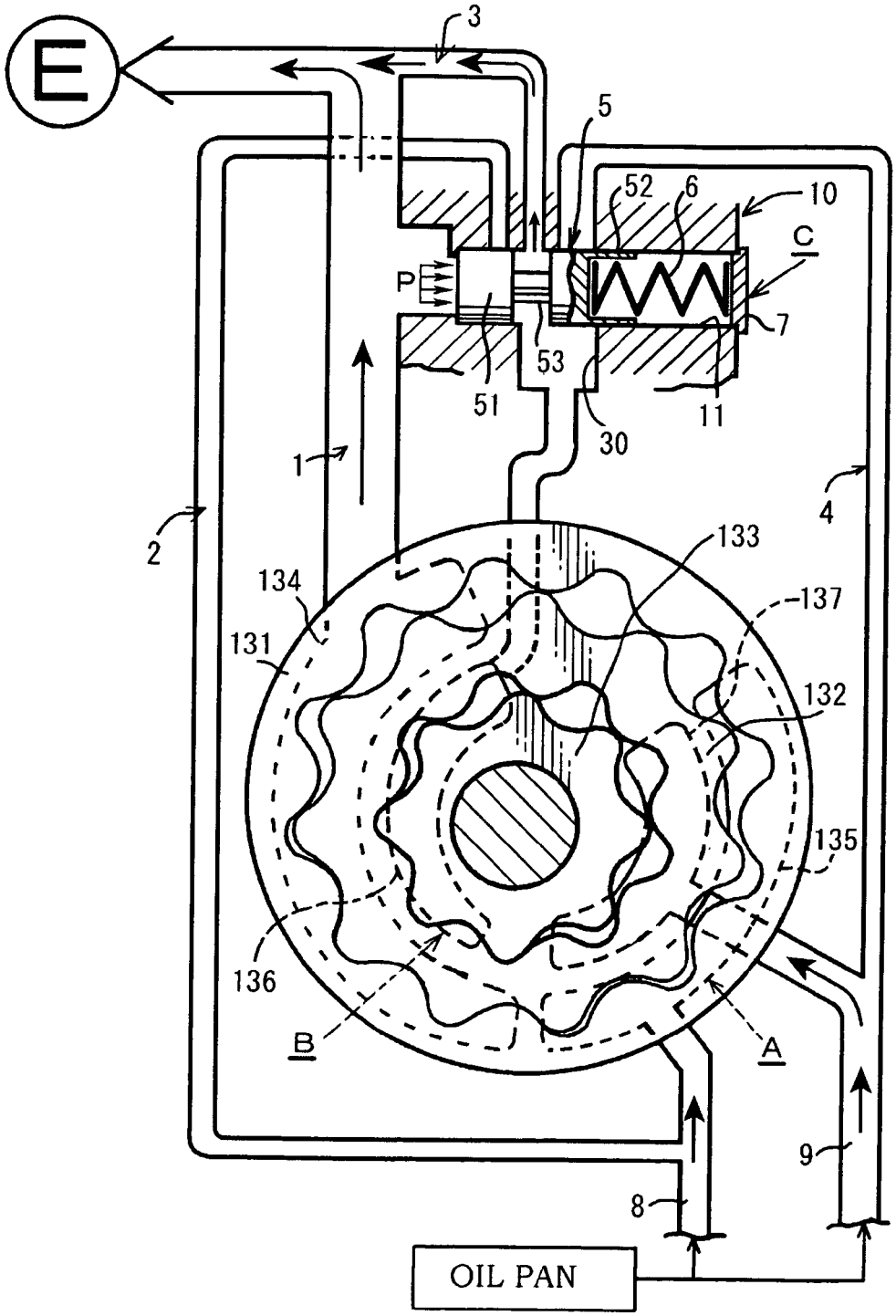
FIG. 6 is a systems diagram of a second embodiment of the present invention showing a state in an engine low revolution range.

In addition, the first rotor assembly A and the second rotor assembly B of the second embodiment constitutes a single oil pump having at least three rotors. More specifically, as shown in FIG. 6, a first rotor assembly A is configured from an outer rotor 131, a middle rotor 132, a discharge port 134 and an intake port 135. In addition, a second rotor assembly B is configured from a middle rotor 132, an inner rotor 133, a discharge port 136 and an intake port 137. In other words, a single oil pump is configured from a three-rotor first rotor assembly A and second rotor assembly B. The configuration of the discharge passages, return passages and pressure control valve C of the pressure control device of the first rotor assembly A and second rotor assembly B of the second embodiment is the same as that of the first embodiment. Accordingly, the action of the second embodiment is the same as the action of the first embodiment as shown in FIG. 1 to FIG. 3. As a result, a description thereof has been omitted. The effect thereof is also the same and, accordingly, a description of the effect of this embodiment has also been omitted. FIG. 6 is a state diagram of engine revolution number in the low revolution range.

Figure 7:
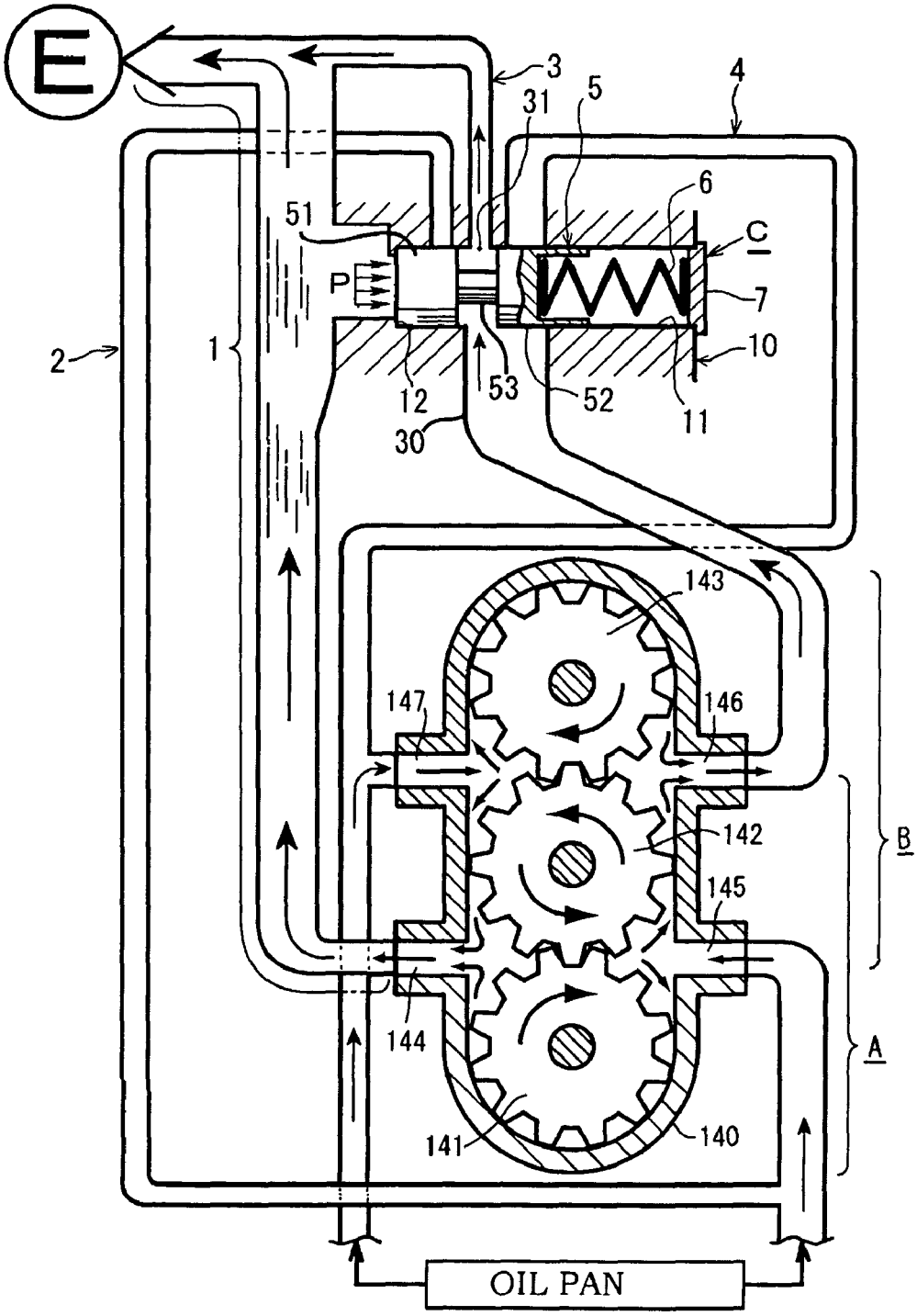
FIG. 7 is a systems diagram of a third embodiment of the present invention showing a state in an engine low revolution range.
Figure 8:
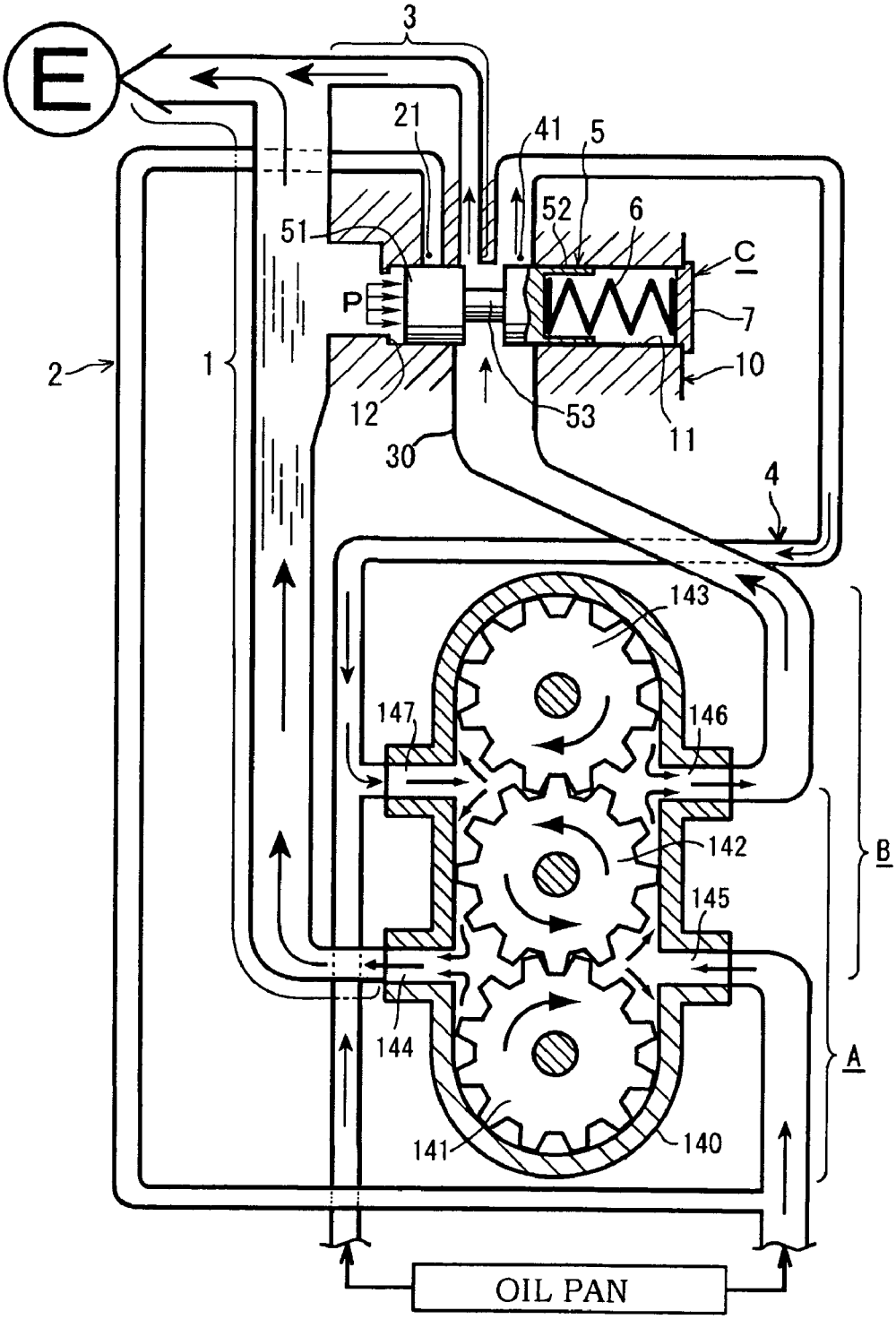
FIG. 8 is a systems diagram of the third embodiment of the present invention showing a state in an engine intermediate revolution range.
Figure 9:
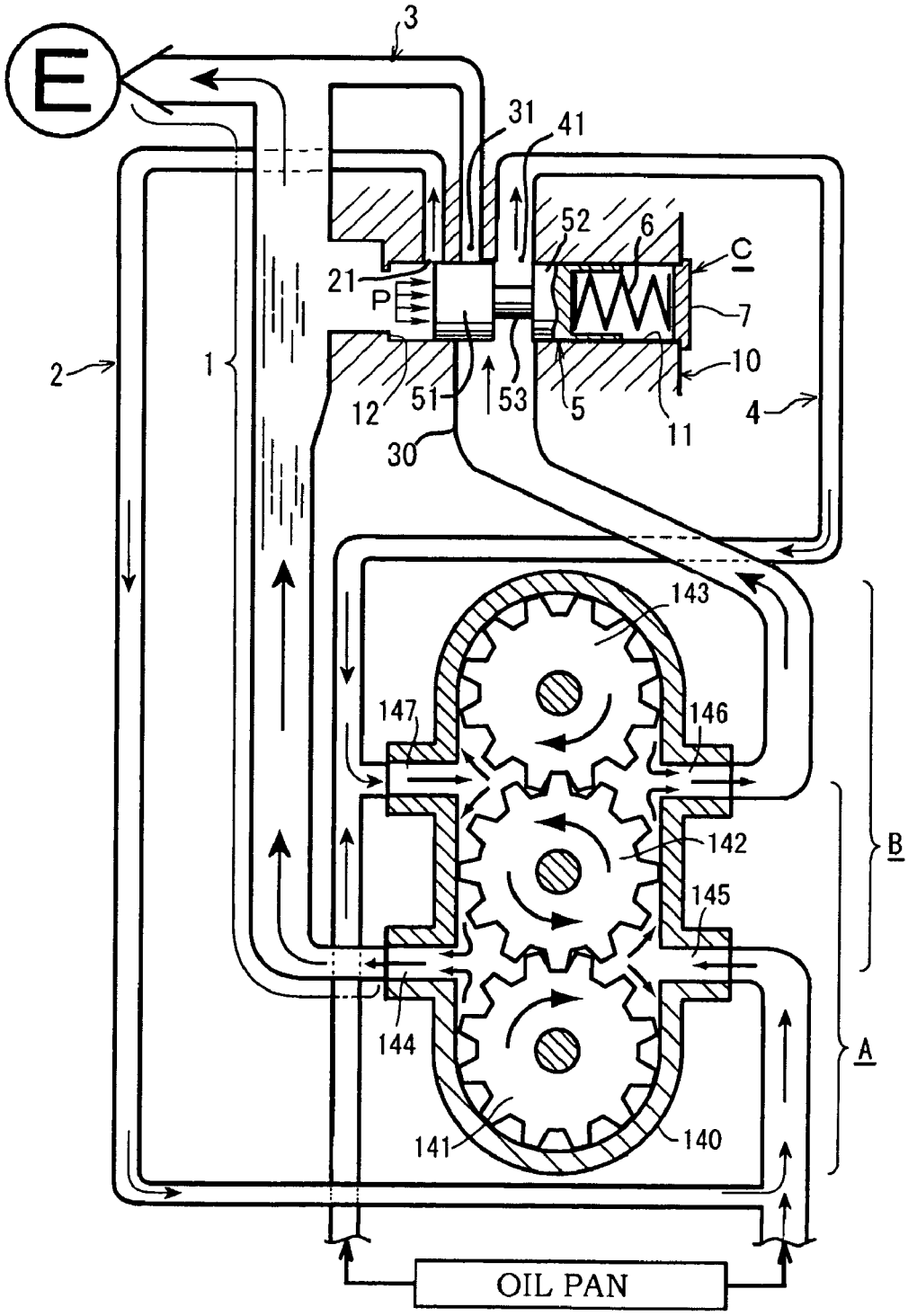
FIG. 9 is a systems diagram of the third embodiment of the present invention showing a state in an engine high revolution range.

In addition, the first rotor assembly A and second rotor assembly B of a third embodiment constitute a single oil pump configured from at least three gears. More specifically, as shown in FIGS. 7 to 9, a first rotor assembly A is configured from a first gear 141, a second gear 142, a discharge port 144 and an intake port 145 provided in a casing 140. In addition, a second rotor assembly B is configured from a second gear 142, a third gear 143, a discharge port 146 and an intake port 147 provided in the casing 140. In other words, it is configured as a single oil pump comprising a first rotor assembly A and a second rotor assembly B of three gears. The configuration of the discharge passages, return passages and pressure control valve C of the pressure control device of the first rotor assembly A and second rotor assembly B of the third embodiment is the same as that of the first embodiment.

The operation of the pressure control valve C of the first rotor assembly A and second rotor assembly B of the third embodiment will be hereinafter described. First, in the low revolution range of the first rotor assembly A and second rotor assembly B, in other words, when the engine revolution number is in the low revolution range which constitutes the state of FIG. 7, the operation of the first valve portion 51 and second valve portion 52 of the pressure control valve C is the same as that of FIG. 1 and, accordingly, a description thereof has been omitted. The characteristics in the low revolution range under these conditions are shown in the characteristics graph of the revolution number and discharge pressure [see FIG. 5A] or characteristics graph of revolution number and discharge flow rate [see FIG. 5B].

A state in which the engine revolution number has risen further is taken as the intermediate revolution range. In this state, which constitutes the state of FIG. 8, the operation of the pressure control valve C is the same as that of FIG. 2 and, accordingly, a description of the operation thereof has been omitted. The characteristics in the intermediate revolution range are expressed in the pressure characteristics graphs (see FIG. 5) of revolution number with respect to discharge pressure or discharge flow rate and, while the increase in the first rotor assembly A is steady, a negative discharge flow rate is produced at the second rotor assembly B side due to backflow, and a pressure linking line obtained as a sum of the first rotor assembly A and second rotor assembly B can be formed to be substantially the same as the pressure characteristics of a conventional oil pump.

A state in which the engine revolution number has increased further is taken as the high revolution range. In this state, which constitutes the state of FIG. 9, the operation of the pressure control valve C is the same as that of FIG. 3 and, accordingly, a description thereof has been omitted. The characteristics in the high revolution range are expressed in the pressure characteristics graphs (see FIG. 5) of revolution number with respect to the discharge pressure or discharge flow rate and, while the first rotor assembly A gradually rises, the second rotor assembly B is in a closed state and the pressure linking line obtained as a sum of the first rotor assembly A and second rotor assembly B is equivalent to that of the first rotor assembly A alone. Because of the decrease in friction (torque) due to the drop in the pressure of the second rotor assembly B in this way, the efficiency is increased.

What is claimed is:

1. An oil pump pressure control device comprising:

a first discharge passage for feeding oil from a first rotor assembly to an engine;

a first return passage that returns to an intake passage of the first rotor assembly;

a second discharge passage for feeding oil from a second rotor assembly to the engine;

a second return passage that returns to an intake passage of the second rotor assembly; and a pressure control valve whose valve main body configured from a first valve portion, a narrow diameter coupling portion and a second valve portion is provided between a discharge port from the second rotor assembly and the first discharge passage, wherein an end portion side of the second discharge passage is coupled to a position along the first discharge passage, and a flow passage control is executed in each of:

a low revolution range in a state in which only the first discharge passage and the second discharge passage are open and communicate with each other;

an intermediate revolution range in a state in which the first discharge passage and the second discharge passage are open and communicate with each other and the first return passage is closed while the second return passage is open; and a high revolution range in a state in which the second discharge passage is closed while the first discharge passage is open, thereby canceling the communication thereof, and the first return passage and the second return passage are open.

2. The oil pump pressure control device according to claim 1, wherein the first rotor assembly and the second rotor assembly each are configured to serve as separate pumps.

3. The oil pump pressure control device according to claim 1, wherein the first rotor assembly and the second rotor assembly are configured as a single oil pump comprising at least three rotors.

4. The oil pump pressure control device according to claim 1, wherein the second discharge passage passes through the pressure control valve.

5. An oil pump pressure control device comprising:

a first discharge passage for feeding oil from a first rotor assembly to an engine;

a first return passage that returns to an intake passage of the first rotor assembly;

a second discharge passage for feeding oil from a second rotor assembly to the engine;

a second return passage that returns to an intake passage of the second rotor assembly; and a pressure control valve whose valve main body configured from a first valve portion, a narrow diameter coupling portion and a second valve portion is provided between a discharge port from the second rotor assembly and the first discharge passage, wherein an end portion side of the second discharge passage is coupled to a position along the first discharge passage, and a flow passage control is executed in each of:

a low revolution range in a state in which only the first discharge passage and the second discharge passage are open and communicate with each other;

an intermediate revolution range in a state in which the first discharge passage and the second discharge passage are open and communicate with each other and the first return passage is closed while the second return passage is open; and a high revolution range in a state in which the second discharge passage is closed while the first discharge passage is open, thereby canceling the communication thereof, and the first return passage and the second return passage are open, wherein the first discharge passage does not pass through the pressure control valve.

6. The oil pump pressure control device according to claim 1, wherein the second discharge passage passes through the pressure control valve, and wherein the first discharge passage does not pass through the pressure control valve.

7. The oil pump pressure control device according to claim 1, wherein in the intermediate revolution range the second discharge passage begins to close.

8. The oil pump pressure control device according to claim 1, wherein in the intermediate revolution range the second return passage beings to open.

9. The oil pump pressure control device according to claim 1, wherein in the high revolution range the first discharge passage and the second discharge are not in communication.

10. The oil pump pressure control device according to claim 1, wherein in the high revolution range the discharge portion from the second rotor assembly is closed.

11. The oil pump pressure control device according to claim 1, wherein the second discharge passage does not extend downstream of the pressure control valve.

12. The oil pump pressure control device according to claim 1, wherein in the low revolution range the first return passage and the second return passage are closed by the first valve portion and the second valve portion.

13. The oil pump pressure control device according to claim 1, wherein the second discharge passage comprises a portion where a cross-sectional area flow rate is reduced.

14. The oil pump pressure control device according to claim 1, wherein the first discharge passage and the second discharge passage are coupled at a position between the pressure control valve and the engine.

* * * * *